US005390657A

United States Patent [19]

Larson

[11] Patent Number: 5,390,657

[45] Date of Patent: Feb. 21, 1995

[54] ADJUSTABLE NOCK SET FOR ARCHERY BOWS

[75] Inventor: Marlow W. Larson, Ogden, Utah

[73] Assignee: Browning, Morgan, Utah

[21] Appl. No.: 783,902

[22] Filed: Oct. 29, 1991

[51] Int. Cl.[6] ..... F41B 5/00

[52] U.S. Cl. ..... 124/91; 124/90

[58] Field of Search ..... 124/91, 90, 86, 23.1

[56] References Cited

U.S. PATENT DOCUMENTS 2,905,166 9/1959 Niemeyer ..... 124/91

3,010,447 11/1961 Roemer ..... 124/91

3,756,215 9/1973 Black ..... 124/91

4,909,233 3/1990 Stephenson ..... 124/91

*Primary Examiner*—Randolph A. Reese

*Assistant Examiner*—Harry C. Kim

*Attorney, Agent, or Firm*—Trask, Britt & Rossa

[57] ABSTRACT

A nock set for an archery bow is structured with contact surfaces which register with the spiraling inclined plane surface configuration of the serving on the bowstring, thereby facilitating elevational adjustments of the nock set.

1 Claim, 1 Drawing Sheet

ADJUSTABLE NOCK SET FOR ARCHERY BOWS

BACKGROUND

1. Field

This invention pertains to archery bows. It is particularly directed to nock sets associated with the bowstrings of such bows, and provides an assembly permitting the adjustable positioning of a nock set at any selected elevation along the central stretch of a bowstring.

2. State of the Art

The firing of a arrow from virtually any archery bow involves the nocking of the arrow on the bowstring. In so doing, the slotted nock of the arrow is positioned at the "nocking point" of the bowstring. Proper location of the nocking point is of importance to an archer, because the attitude of an arrow when it is launched has a definite impact on its flight path. Consistent shooting requires consistent nocking. It has become conventional practice to assure this consistency by installing a "nock set" at a selected elevational location along the central stretch of the bowstring.

By "central stretch" is meant the working portion of the bowstring, a middle section of which includes the available nocking points. This middle section is often protected from wear by a helical wrapping or "serving."

The term "elevational," as used in this disclosure, assumes an archery bow held in its normal position of use, approximately vertically. Thus, for example, a higher elevational position places the nocking point closer to the upper limb tip and further from the lower limb tip.

Nock sets, as currently known, are small metal or plastic devices, typically a split ring, capable of being crimped to a bowstring, thereby establishing a nocking point. If for any reason it is subsequently desired to change the elevational position of the nocking point, it is necessary to mechanically spread the ring or similar structure and to recrimp it to the bowstring at a different location. This procedure lacks precision and exposes the serving to unusually harsh wear conditions.

The servings generally encountered on modern bowstrings are fashioned by winding a monofilament line transversely around the middle section of the central stretch of a multi-strand bowstring. There results an exterior surface configuration similar to an external screw thread; that is, a spiraling inclined plane. This exterior surface resists movement of the crimped nock set from its initial location, thereby contributing to its positive placement.

There remains a need for a nock set capable of both positive placement and easy relocation with reduced risk of damage to the serving of a bowstring.

SUMMARY OF THE INVENTION

This invention provides a nock set assembly which is structured and arranged to permit its easy relocation to selected elevational positions on a serving in the middle section of the central stretch of a bowstring. The assembly of this invention takes advantage of the exterior screw-like surface configuration characteristic of typical servings. That is, the assembly includes an internal contact surface configured approximately as an internal thread which registers with the exterior thread pattern of the serving. Elevational adjustment of the installed nock set is thus readily accomplished by turning it either clockwise or counter clockwise, as appropriate.

The assembly is structured to present an external configuration generally similar to that of conventional nock sets. Although it can be embodied as a crimpable split ring or equivalent structure with an interior string-contacting surface carrying an interior thread, embodiments with segmented bodies are preferred. Segmented bodies facilitate mounting on the bowstring serving section without distorting any of the component parts of the nock set. The segments may be connected by various means, such as hinge/latch devices, slip rings or plug connectors, but threaded fasteners are presently preferred. Threaded fasteners constitute simple means for selectively tightening or loosening the clamping force exerted by the contact surfaces of the segments on the serving. The assembly may thus be firmly locked into position on the serving. When it is desired to change its location, the threaded fasteners can be backed off slightly, thereby permitting rotation of the assembly around the axis of the string. After the assembly achieves its desired new location, the fasteners may again be turned to clamp the assembly in place.

BRIEF DESCRIPTION OF THE DRAWINGS

In the drawings, which illustrate that which is currently regarded as the best mode for carrying out the invention.

DESCRIPTION OF THE ILLUSTRATED EMBODIMENT

Figure 1:
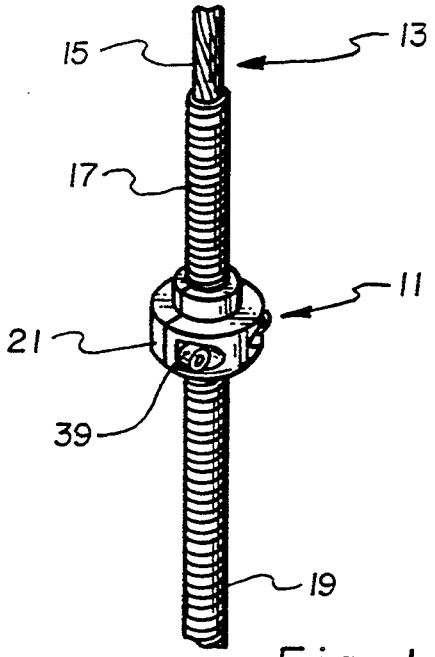
FIG. 1 is a fragmentary pictorial view of an assembly of this invention installed on the serving of a bowstring.
Figure 2:
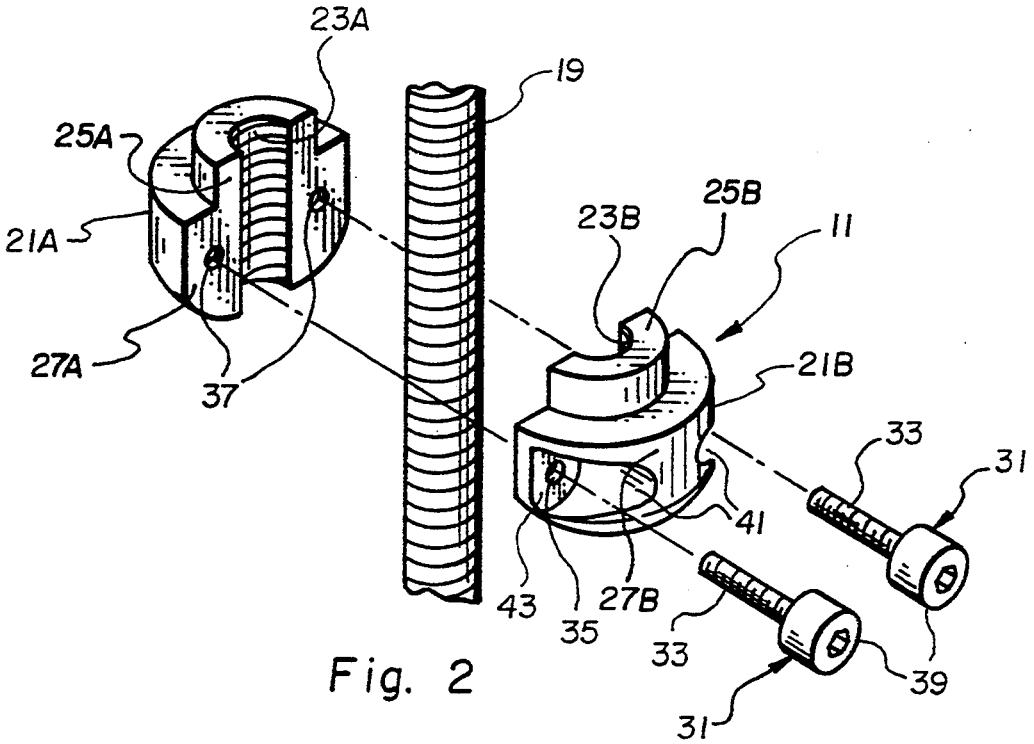
FIG. 2 is an exploded view of the assembly of FIG. 1 in association with a fragment of the serving of FIG. 1.

FIG. 1 illustrates a nock set, designated generally 11, in association with a bowstring, designated generally 13. The string 13 may be a component of any of the large variety of available archery bows. The bow itself is not illustrated because its specific structure is of no importance to the invention. In any case, the string 13 will include a central stretch 15 in which the available nocking points will be located. The selected nocking point will correspond to the location of the nock set 11 on a middle section 17 of the central stretch 15. This section 17 is wrapped with a serving 19 which provides a spiraling inclined plane configuration consistent with a gentle external screw thread.

The assembly 11 consists of a body 21 including first 21A and second 21B segments. These segments 21A, 21B, are structured and configured as shown to clamp the serving 19 between respective contact surfaces 23A, 23B. The contact surfaces 23A, 23B, are configured as internal screw threads which approximately match, or register with, the external screw thread configuration provided by the serving 19.

The segments 21A, 21B include corresponding elements 25A, 25B of reduced diameter and corresponding elements 27A, 27B, of greater diameter, having sufficient mass to accommodate the threaded bolts 31. The shafts 33 of the bolts 31 pass freely through bores 35 in the segment 21B and turn into threaded holes 37 in the segment 21A. The heads 39 of the bolts 31 are received by appropriate recesses 41 provided in the segment 21B. FIG. 1 shows the assembly 11 installed on the serving 19 as appropriate for normal use. With the bolts 31 turned tight so that the bolt heads 39 bear against the surfaces 43, the contact surfaces 23A, 23B, clamp tightly against the serving 19 so that the assembly 11 resists movement. If the bolt heads 39 are retracted slightly to reduce the pressure on the surfaces 43, the assembly 11 is loosened sufficiently to permit its turning either to the left or to the right. The thread configurations of the serving 19 and the contact surfaces 23A, 23B, are sufficiently engaged to effect a precise elevational adjustment of the position of the assembly 11 on the serving 19.

Reference in this disclosure to details of the illustrated embodiment is not intended to limit the scope of the claims which themselves recite those features regarded as important to the invention and are intended to include equivalents. One of ordinary skill in the art of archery will be adequately instructed by this disclosure to embody this invention in specific configurations other than that illustrated. For example, while the illustrated embodiment includes two segments, a greater number of segments of differing shapes may be desired in certain circumstances. Moreover, it is recognized that a variety of specific contact surface configurations are capable of functioning as a screw thread.

What is claimed is:

1. A nock set for an archery bow, said bow including a bowstring having a central stretch with a middle section characterized by a spiraling inclined plane surface configuration, said nock set comprising:

a body assembly, including a first segment and a second segment mutually adapted to clamp said middle section so that corresponding first and second contact surfaces of said first and second segments, respectively, engage said middle section, said contact surfaces being configured to register with said spiraling inclined plane surface;

connecting means for joining said first and second segments in clamping relationship with said middle section so that said assembly may be rotated clockwise or counterclockwise, as desired, to adjust the elevational position of said assembly on said middle section;

said middle section being wrapped with a serving which provides said spiraling inclined plane surface;

said contact surfaces being configured as internal threads which approximately match said spiraling inclined plane surface; and wherein said connecting means comprises threaded connectors constructed and arranged to permit selective adjustment of the clamping force exerted by said contact surfaces against said inclined plane surface, whereby said assembly may be selectively tightened into a fixed elevational position on said middle section or loosened to permit rotation of said assembly to effect an adjustment of said elevational position.

* * * * *